US010316483B2

(12) United States Patent
Haeckel et al.

(10) Patent No.: US 10,316,483 B2
(45) Date of Patent: Jun. 11, 2019

(54) METHOD FOR MECHANICALLY STABILIZING DEEP SEA SEDIMENTS, MARINE RAW MATERIAL DEPOSITS AND/OR SUBMARINE SLOPE AND/OR CONTROL/CONDITIONING METHOD OF THE HYDRAULIC PROPERTIES OF DEEP SEA SEDIMENTS

(71) Applicant: GEOMAR Helmholtz-Zentrum für Ozeanforschung Kiel, Kiel (DE)

(72) Inventors: Matthias Haeckel, Kiel (DE); Christian Deusner, Kiel (DE)

(73) Assignee: GEOMAR Helmholtz-Zentrum fuer Ozeanforschung Kiel, Kiel (DE)

( * ) Notice: Subject to any disclaimer, the term of this patent is extended or adjusted under 35 U.S.C. 154(b) by 0 days.

(21) Appl. No.: 15/572,224

(22) PCT Filed: May 4, 2016

(86) PCT No.: PCT/DE2016/100203

§ 371 (c)(1),
(2) Date: Nov. 7, 2017

(87) PCT Pub. No.: WO2016/180402

PCT Pub. Date: Nov. 17, 2016

(65) Prior Publication Data

US 2018/0127937 A1 May 10, 2018

(30) Foreign Application Priority Data

May 8, 2015 (DE) ..... 10 2015 107 252

(51) Int. Cl.
*E02D 3/12* (2006.01)
*E02D 27/52* (2006.01)
(Continued)

(52) U.S. Cl.
CPC ..... *E02D 3/12* (2013.01); *E02D 27/52* (2013.01); *E21B 7/12* (2013.01); *E21B 41/00* (2013.01);
(Continued)

(58) Field of Classification Search
CPC ..... E21B 43/16; E21B 43/164; E02D 3/12; E02D 27/52
(Continued)

(56) References Cited

U.S. PATENT DOCUMENTS 4,344,722 A * 8/1982 Blais ..... C09K 17/00 405/129.75
4,415,365 A * 11/1983 Spars ..... C04B 7/30 106/638
(Continued)

FOREIGN PATENT DOCUMENTS

DE 102009055175 A1 6/2011
DE 102010026524 A1 1/2012
(Continued)

OTHER PUBLICATIONS

B. P. Mcgrail, et al "Using Carbon Dioxide to Enhance Recovery of Methane from Gas Hydrate Reservoirs: Final Summary Report", Sep. 1, 2007 (Sep. 1, 2007), XP055049868, Retrieved from the Internet: URL:http://www.pnl.gov/main/publications/external/technical_reports/pnn1-17035.pdf [retrieved on Jan. 16, 2013], the whole document, paragraph [1.2.4].
(Continued)

*Primary Examiner* — Frederick L Lagman
(74) *Attorney, Agent, or Firm* — Patent Central LLC; Stephen A. Pendorf

(57) ABSTRACT

A method for mechanically stabilizing deep sea sediments, marine raw material deposits and/or submarine slope and/or to a control/conditioning method for the hydraulic properties
(Continued)

of deep sea sediments. A gas hydrate-forming substance is injected into marine or submarine sediments, and gas hydrate sediment composites are formed.

18 Claims, 10 Drawing Sheets

(51) Int. Cl.
*E21B 43/16* (2006.01)
*E21B 7/12* (2006.01)
*E21B 41/00* (2006.01)
*E21B 43/01* (2006.01)

(52) U.S. Cl.
CPC ..... *E21B 43/01* (2013.01); *E21B 43/164* (2013.01); *E21B 2043/0115* (2013.01)

(58) Field of Classification Search
USPC ..... 405/302.4, 302.6
See application file for complete search history.

(56) References Cited

U.S. PATENT DOCUMENTS 5,897,946 A * 4/1999 Nachtman ..... E02B 3/12 405/17
6,386,796 B1 * 5/2002 Hull ..... B09C 1/00 405/128.1
7,011,766 B1 * 3/2006 Hull ..... B09C 1/08 252/88.1
7,438,500 B2 * 10/2008 Hull ..... C04B 20/1055 106/705
8,048,309 B2 * 11/2011 Osegovic ..... C02F 1/22 210/642
2003/0070435 A1 * 4/2003 West ..... A01K 63/042 62/53.1
2004/0200618 A1 * 10/2004 Piekenbrock ..... E21B 41/0057 166/305.1
2005/0121200 A1 * 6/2005 Sivaraman ..... B01D 53/1475 166/370
2013/0266380 A1 * 10/2013 Capron ..... F16L 1/24 405/184.4
2013/0341179 A1 * 12/2013 Singhe ..... B01J 19/121 204/158.21
2014/0262265 A1 * 9/2014 Hutchins ..... C09K 8/92 166/280.2
2015/0107826 A1 4/2015 Lee et al.

FOREIGN PATENT DOCUMENTS

GB 2188699 A 10/1987
GB 2445120 A 6/2008
WO 2010088874 A2 8/2010
WO WO-2010145676 A1 * 12/2010 ..... C09K 8/52
WO 2015002544 A2 1/2015

OTHER PUBLICATIONS

Christian Deusner et al "Methane Production from Gas Hydrate Deposits through Injection of Supercritical CO2", Energies, vol. 5, No. 12, Dec. 25, 2012 (Dec. 25, 2012), pp. 2112-2140, XP055305019, CH ISSN: 1996-1073, DOI: 10.3390/en5072112, p. 2113, paragraph 5, p. 2114, paragraph 3; figures 1, 2 pp. 2123-2123.25, paragraph 3.1.3; pp. 2125-2125.29, paragraph 31; figure 7; pp. 2130-2130.36, paragraph 4.2-6; figure 9.

Silke Roentzsch "Bohrtechnische Erschliessung submariner Gashydratlagerstaetten", Jan. 1, 2014 (Jan. 1, 2014), XP055304915, Jun. 25, 2014, Retrieved from the Internet: URL:http://www.qucosa.de/fileadmin/data/qucosa/documents/14722/Bohrtechnische Erschliessung submariner Gashydratlagerstaetten_Diss. Silke Röntzsch_25.06.2014.pdf, [retrieved on Sep. 22, 2016] pp. 23-25, paragraphs 2.7.3, 2.7.4; figures 1-4,8,11; p. 67; figure 43, the whole document.

International Search Report in International Application No. PCT/DE2016/100203 dated Sep. 30, 2016.

* cited by examiner

METHOD FOR MECHANICALLY STABILIZING DEEP SEA SEDIMENTS, MARINE RAW MATERIAL DEPOSITS AND/OR SUBMARINE SLOPE AND/OR CONTROL/CONDITIONING METHOD OF THE HYDRAULIC PROPERTIES OF DEEP SEA SEDIMENTS

BACKGROUND OF THE INVENTION

Field of the Invention

The invention relates to a mechanical stabilization method for deep sea sediment, marine raw material deposits, and/or deep sea slope and/or a method for controlling/conditioning of the hydraulic properties of deep sea sediments.

In general, the invention relates to a method which makes it possible to mechanically stabilize deep-sea sediments, marine raw material deposits and submarine slopes, and to control hydraulic characteristics of deep sea sediments. In particular applications, the invention serves in the construction and mechanical stabilization of deep foundations, anchorages and wells, as well as the closing of subsea leaks. A mechanical stabilization and hydraulic conditioning of deep-sea sediments is needed particularly in the production of natural gas from marine gas hydrate deposits, in order to prevent, inter alia, production of sand and water.

Description of the Related Art

For numerous industrial and scientific operations (e.g., deep-water drilling, oil and gas exploration, environmental monitoring) very valuable technical equipment must be placed on the sea floor or in submarine sediments and operated safely over defined periods of time. There is a need for solid foundations for the placement and operation of these technical platforms on the seabed. Therein technical problems (e.g., sinking of heavy equipment, collapse of boreholes, warping and buckling of pipelines) can occur due to a destabilization of the sediments during the operating periods.

Anchorages are required for all offshore platforms (e.g., drilling rigs or subsea installations in the oil and gas industry) which are operated in the deep sea environment. The anchoring systems serve to position the platforms, which are generally designed for long-term operation. Since industrial applications are advancing into ever greater depths of water, numerous anchoring concepts have been developed for various load scenarios over the last years. It is a special problem that dynamic loads caused by wind and waves have to be tolerated by the anchors on the seabed. All anchoring systems serve to transfer the load into the sediment. Depending on the degree and nature of the consolidation of the natural sediments, this load transfer is problematic since, for example, poorly consolidated sediments can absorb tensile and shear forces and distribute them in the seabed only to a very small extent. Accordingly, the anchors are large in size and have a considerable "footprint" on the seabed. The placement and, in particular, the positioning of the systems in the sediment is very difficult. Frequently several large offshore platforms are required for these tasks, which coordinate the placement of the anchors.

GB 2188699 discloses a method of vibration damping in off-shore drilling rigs, which absorbs dynamic loads by means of elastomers.

The implementation and construction of deep-sea drilling rigs is of considerable technical and economic importance, especially in the oil and gas industry. First of all, the drilling of unconsolidated sediments is problematic, since the drilling is difficult to stabilize and a collapse cannot be ruled out as a result of the drilling load. In particular, the penetration of sediment layers with natural gas hydrates can lead, due to the considerable local energy input, to a dissociation of the natural gas hydrate, leading to an increase in the pore pressure and to a weakening of the sediment and a threatening to the bore. Destabilization of the naturally existing gas hydrates may also be caused for example by extraction of hot oil and gas or by the injection of hot water (SAGD=steam assisted gravity drainage). Movements of the sediment can also pose a threat to the borehole.

The extraction of raw materials from marine gas hydrate requires a mechanical stabilization and hydraulic conditioning of gas hydrate deposits during production and subsequent storage of the exploited deposit. The current state of the art is confronted with several unresolved technical problems for future gas production from marine gas hydrate deposits. These problems became apparent in the 2012 and 2013 field tests in the permafrost of Alaska and in the Nankai-trough offshore of Japan and have put the success of the field tests at risk. A central problem was the production of sand, which resulted from the destabilization of the gas hydrate by pressure drops and induced gas-water fluid flows. The destabilization of the environment of the borehole, which precedes the massive sand production, can lead to irreversible loss of the borehole and considerable costs. A further problem was the early onset of water production, especially when carrying out the offshore field test in Japan. Water production is an indication of the presence of permeable zones through which additional formation water penetrates into the deposit. The penetration of water defines the maximum adjustable pressure gradient and limits the maximum yield in the gas production. Model calculations have also shown that the sedimentation of the sediments due to dynamic loads must also be expected, especially after completion of the production, since the production causes destabilizing load changes (increase of the effective pressure during production and reduction of the effective pressure after completion of production).

Both as a result of gas production from marine gas hydrate deposits as well as by a destabilization of natural gas hydrates due to climatic changes (warming of the sea floor) can lead to a destabilization of submarine slopes. Submarine landslides can carry considerably larger volumes of solids over longer distances than landslides on land. Especially areas with rapidly sedimented, unconsolidated material are endangered or areas with high pore pressure. The failure mechanism in the situations described results from a relatively high pore pressure compared to sediment load bearing ability, which leads to a reduction in shear resistance. The relatively high pore pressure is caused by dissociation of gas hydrates or by load changes in the production of gas from gas hydrates. Other causes and mechanisms of slope destabilization are known (e.g., natural gas sources).

DE 10 2010 026 524 A1 proposes to temporarily and reversibly seal leaks which occur during the extraction of natural gas, petroleum, water with the aid of a cryogen. As the cryogen, the use of liquid hydrogen, nitrogen, oxygen or dry ice is envisioned. There is no fusion with the sediments, the system is not suitable or intended for foundations and foundations.

From DE 10 2009 055 175 B4, foundations for masts of off-shore wind energy installations are known, which can be readjusted in the event of tilting by the filling of previously placed "empty cushions" with "pressing material". The system is not intended for the stabilization of sediments, but it can only react to a misalignment of masts within a predefined range.

BRIEF SUMMARY OF THE INVENTION

It is an object of the invention to provide a system, which solves the hydraulic and mechanical problems occurring due to destabilized foundations, static and dynamic loads of sediments, destabilization of bores, leaks, and water production, destabilization of gas hydrate deposits and destabilization of deep sea slopes.

The object of the invention is achieved with a mechanical stabilization method for deep sea sediment, marine raw material deposits, and/or deep sea slope and/or a method for control/conditioning according the main claim.

The method for mechanical stabilization of deep sea sediment, marine raw material deposits, and/or deep sea slope and/or for control/conditioning of the hydraulic properties of deep sea sediments comprises an injection of a gas hydrate forming substance in marine or submarine sediments, whereby gas hydrate sediment composites are formed.

At this point, it should be noted that these are gas hydrate sediment composites!

The method can further comprise that to form the gas hydrate sedimentary composites for static loads and low permeability the injection of the gas hydrate forming substances occurs in a non-surface-wetting fluid phase under water-limited conditions.

Further, the method may comprise that the gas hydrate sediment composites are formed solid, stiff, low-deformable and low-permeable.

In a further embodiment, the gas hydrates can be formed at fluid-tight and/or fluid-fluid phase boundary surfaces and/or pore holes. In this respect, the sediment particles combine predominantly positively (form-fitting).

The method can further comprise that, to form the gas hydrate sediment composites for dynamic loads and high permeability, the injection of the gas hydrate forming substances occurs in a surface-wetting fluid phase under non-water-limited conditions. Furthermore, the method can be further developed in that the injection of the gas hydrate forming substances forms deformable, permeable gas hydrate sediment composites.

The method may further include that the gas hydrates formed by injecting the gas hydrate forming substances are formed in pore spaces and do not, or predominantly non-positively (frictional connection, friction locked, actuated by adherence), connect the sediment particles.

According to the invention, a deep-sea foundation, a deep-anchorage, a borehole and/or a closure of a borehole may be constructed before, during or after the formation of the gas hydrate sedimentary composites. Furthermore, the formation of the gas hydrate sediment composites can be used to establish a filter layer and/or technical barrier, as well as prevent slippage and/or sediment movements. According to the invention, natural gas or petroleum can be extracted before, during or after the formation of the gas hydrate sediment composites.

The method may further include that the injection of the gas hydrate forming substances is carried out under time and/or local availability of water, if at the time of forming of the gas hydrate sediment composites a water-limitation exists, if at the time of formation of gas hydrate sediment composites no mobile water is available, or the available water is not present as a continuous phase, wherein the presently available water wets surfaces in the gas hydrate sediment composite and by capillarity forces is retained in pore throats, or as part of the injection fluid is temporarily in the form of a dispersed, non-continuous phase.

The method may further include that the injection of the gas hydrate forming substances is carried out under time and/or local availability of water, wherein during the formation of the gas hydrate sediment composites under water limitation the gas hydrate forming gas is present in excess and the maximum amount at gas hydrate which may be formed at the time is limited by the amount of water.

Further, the method may comprise that the injection of the gas hydrate forming substances takes place under temporal and/or local availability of water, wherein the availability of water is controlled by injecting a non-sediment-wetting phase and the targeted displacement of available pore water or by the defined addition of water as component of the injection fluid.

The method may further include that the injection of the gas hydrate forming substances occurs by means of a defined surface wetting or surface non-wetting fluid, or fluid mixture, whereby the water availability is controlled and limited or is not limited, wherein the location of the gas hydrate formation and the primary composite type are defined on the grain scale.

The method may, for this, in particular, have the following features:

as surface-wetting fluid phases aqueous solutions with high $CH_4$— or $CO_2$-concentration are used and/or as a non-surface wetting fluid phases $CH_4$ gas or liquid $CO_2$ are used and/or as relevant surfaces, the surfaces of sediment particles, gas hydrates and injected technically relevant solids are used.

and/or the different hydrate-forming components $CO_2$, $CH_4$, $N_2$, $H_2S$, ethane, propane, and/or iso-butane are contained in the fluid phases.

The method may further include that the injection of the gas hydrate forming substances occurs alternately/alternatingly with hydrate formers and water.

The method according to the invention for the mechanical stabilization or hydraulic conditioning of marine sediments, foundations, foundations, drill holes, deep sea slopes and raw material reservoirs is characterized in that gas-hydrate-sediments composites are produced by injection of gas hydrate-forming substances into marine or submarine sediments.

In one embodiment, the inventive method is characterized in that, for stabilization against static loads, the injection of the gas hydrate forming substances takes place in a non-surface-wetting fluid phase under water-limited conditions.

In a further embodiment, the method according to the invention is characterized in that, when stabilizing against dynamic loads, the gas-hydrate-forming substances are injected in a surface-wetting fluid phase or in a non-surface-wetting phase under non-water-limited conditions.

Surprisingly, it was found that the temporal and local availability of water is of great importance for the formation of the defined gas hydrate sediment composites. Water limitation is given when no mobile water is present at the time of the formation of gas hydrate sediment composites or the water present is not available as a continuous phase. The water present under these conditions at wets surfaces in the gas hydrate sediment composite the respective time, is retained by capillary forces in the pore throats, or is temporarily present as a constituent of the injection fluid as a dispersed, non-continuous phase. Water limitation is also characterized in that, during the formation of the gas hydrate sedimentary composites, the gas hydrate forming gas is present in excess, and the maximum amount of gas hydrate which can be formed at the respective point in time is limited by the amount of water. The availability of water is controlled by the injection of a non-sediment-wetting phase and the targeted displacement of existing pore water, or by the defined addition of water as a component of the injection fluid. By the injection of a defined surface-wetting or surface-non-wetting fluid or fluid mixture and the regulation of the water availability (limited or not limited), the location of the gas hydrate formation and the primary composite type are defined on the grain scale.

With the method according to the invention, two different types of gas hydrate sediment composites can be formed by suitable injection of gas-hydrate-forming substances into marine or submarine sediments.

1. By injection of gas hydrate forming chemical substances in a non-surface wetting fluid phase under water-limited conditions solid, rigid, low-ductile and low-permeable gas hydrate sediment composites are rapidly formed. These gas hydrate sediment composites are characterized in that gas hydrates are preferentially formed at fluid-solid or fluid-fluid phase boundary surfaces and, in particular, in pore throats, and sediment particles are predominantly form-fittingly or positively (formschluessig) joined.
2. By the injection of gas hydrate forming chemical substances in a surface wetting fluid phase or by the injection of gas hydrate forming chemical substances in a non-surface wetting fluid phase under non-water limited conditions, deformable permeable gas hydrate sediment composites are formed. These gas hydrate sediment composites are characterized in that gas hydrates are preferentially formed in pore spaces and that sediment particles do not bond, or predominantly bond non-positively, friction-lockingly ("kraftschluessig").

BRIEF DESCRIPTION OF THE SEVERAL VIEWS OF THE DRAWINGS

The present invention is illustrated by way of example and not limitation in the accompanying drawings in which like reference numbers indicate similar parts, and in which.

DETAILED DESCRIPTION OF THE INVENTION

Figure 1:
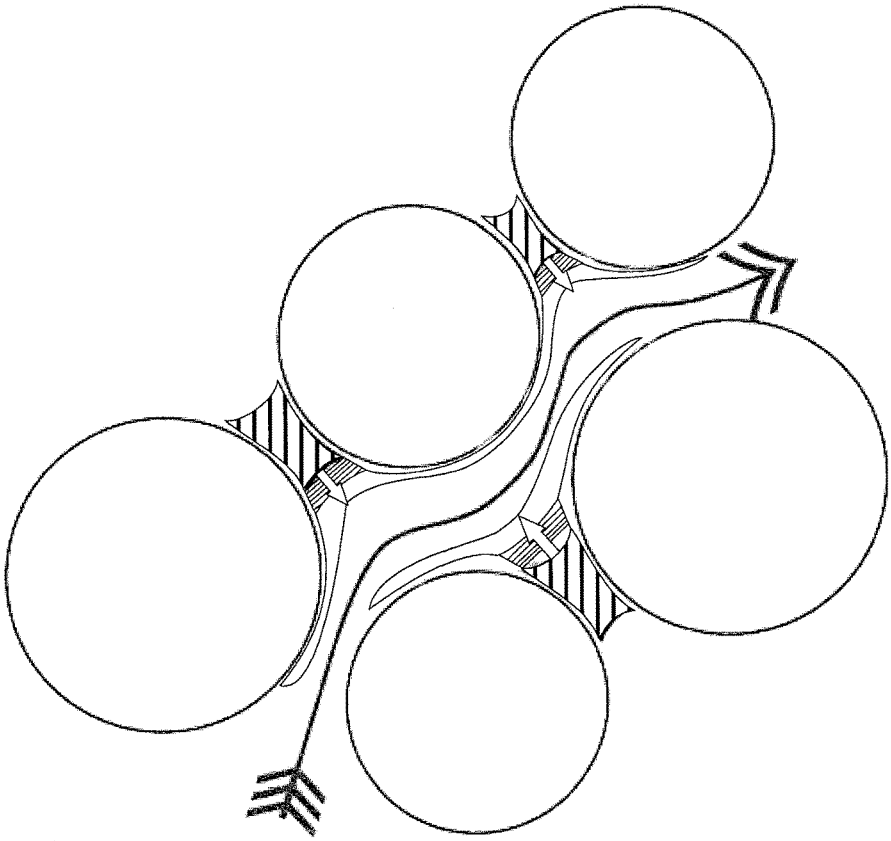
FIG. 1 schematically shows the solid, rigid, low ductility and low permeability gas hydrate sediment composites formed quickly under water-limited conditions by injection of a non surface-wetting fluid phase. Water as sediment wetting fluid component resides at the surface of the form-fitting or positive composites.

FIG. 1 shows schematically the rapidly formed rigid, slightly deformable and slightly permeable gas hydrate sediment composites, formed under water-limited conditions by injection of a non-surface-wetting fluid phase. Water as a sediment-wetting fluid component is deposited on the surface of the positive interlocking ("formschluessig") composites.

Figure 2:
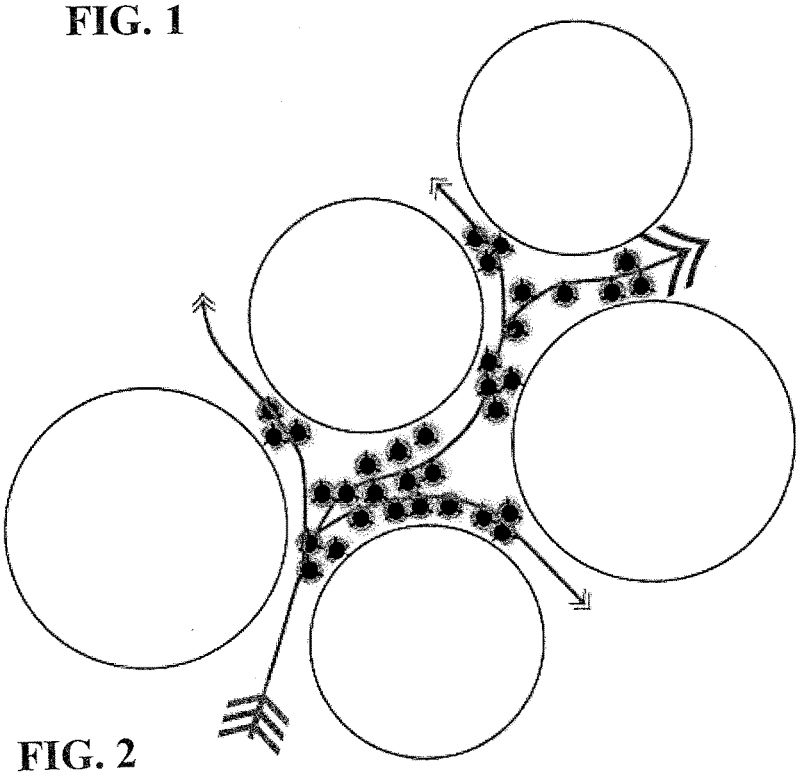
FIG. 2 schematically shows the elastically and plastically deformable, permeable, mainly frictional or non-positive connection gas hydrate sediment composites formed more slowly under non-water-limited conditions. By growth during the injection of sediment-wetting fluids, there arise contact sites and friction surfaces.

FIG. 2 schematically shows the elastically and plastically deformable, permeable, predominantly non-positive gas hydrate sediment composites, which are formed more slowly under non-water-limited conditions. By growing during the injection of sediment-wetting fluid, contact points and friction surfaces are formed.

Typical technical applications for 1.) are:

Foundations and platforms for technical applications in predominantly static loads, Technical barriers, enclosures and seals Well borehole stabilization, Slope stabilization.

Typical technical applications for 2.) are:

Foundations and platforms for technical applications with primarily dynamic loads, Filter and support layers, Stabilization and storage of gas hydrate deposits.

Surface wetting fluid phases are, under suitable conditions, for example, aqueous solutions with high $CH_4$— or $CO_2$-concentrations.

Non-surface wetting fluid phases are, under suitable conditions, for example, $CH_4$ gas or liquid $CO_2$.

Relevant surfaces are surfaces of sediment particles, gas hydrates and injected technically relevant solids.

Experimental Investigations

Figure 3:
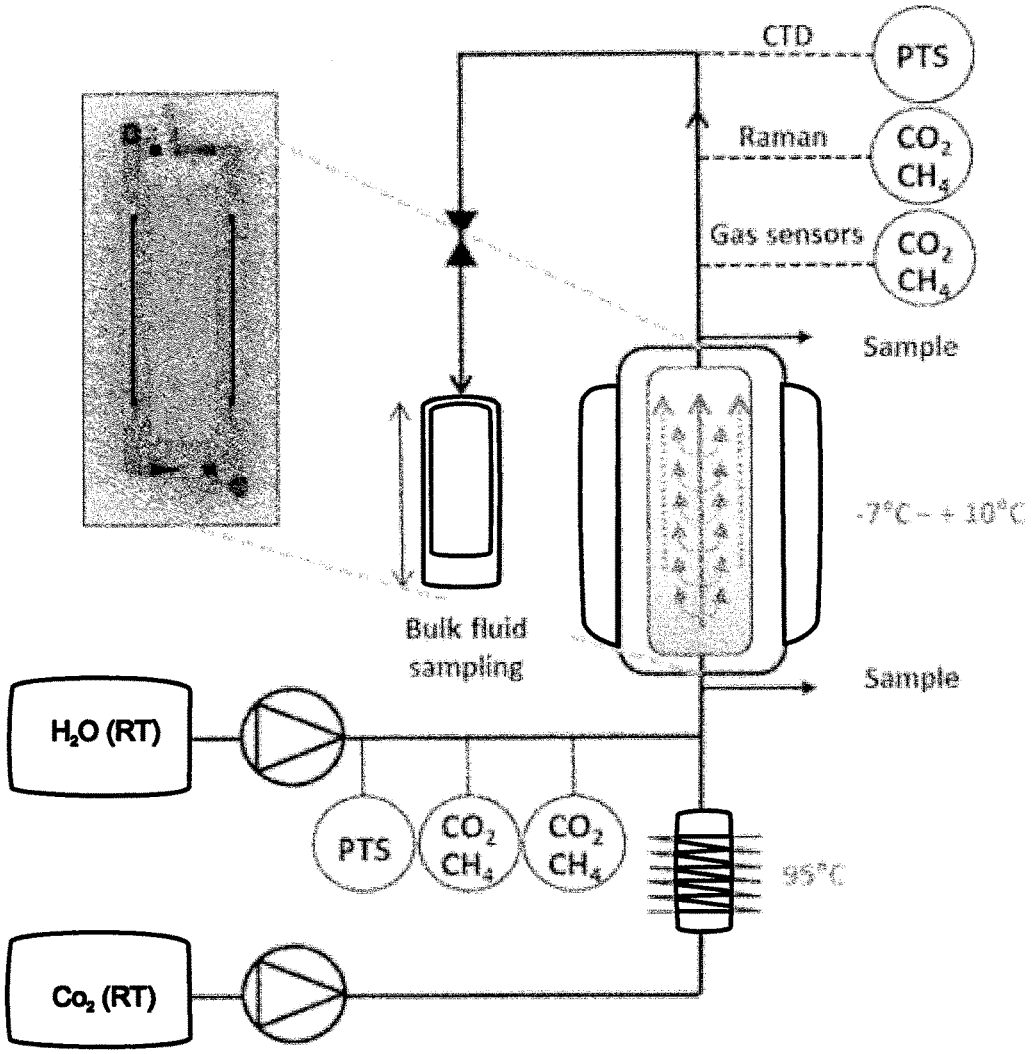
FIG. 3 shows the experimental scheme for high pressure flow-through experiments.

It has surprisingly been shown in experimental studies that gas hydrate sediment composites can be used for technically controlled, mechanical stabilization and hydraulic conditioning of marine sediments. This invention provides a wide range of possible technical applications, as described in the following sections. Different high-pressure experiments were carried out in which $CH_4$, $CO_2$ or $CO_2$:$CH_4$:$N_2$ gas mixtures were introduced in sandy sediments. Many experiments were carried out under flow conditions, and the scheme of an experimental setup is shown in FIG. 3. It has surprisingly been shown that after the fluid has been introduced different processes take place which lead to the formation of gas hydrates and gas hydrate sediment composites, and their properties can be technically influenced in a wide range in an unexpected way.

It has surprisingly been found that with a suitable choice of the technical parameters of temperature, pressure, injection rates, injection sequence and fluid compositions the mechanical stability and hydraulic conductivity of the sediment can be altered in the following respects:

1.) By injecting gas hydrate forming chemical substances in a non-surface wetting fluid phase under water-limited conditions strong, rigid, low-deformable and low-permeable gas hydrate sediment composites are quickly formed. It was found that these gas hydrate sediment composites are characterized in that gas hydrates are preferentially formed at fluid-solid or fluid-fluid phase boundary surfaces and, in particular, in pore throats, and primarily connect sediment particles in a form-fitting manner.

2.) By the injection of gas-hydrate-forming chemical substances in a surface-wetting fluid phase or by the injection of gas-hydrate-forming chemical substances in a non-surface-wetting fluid phase under non water-limited conditions, elastically and plastically deformable permeable gas hydrate sediment composites are formed. These gas hydrate sediment composites are characterized in that gas hydrates are preferentially formed in pore spaces and that sediment particles do not bonded, or predominantly force-lockingly.

Figure 4:
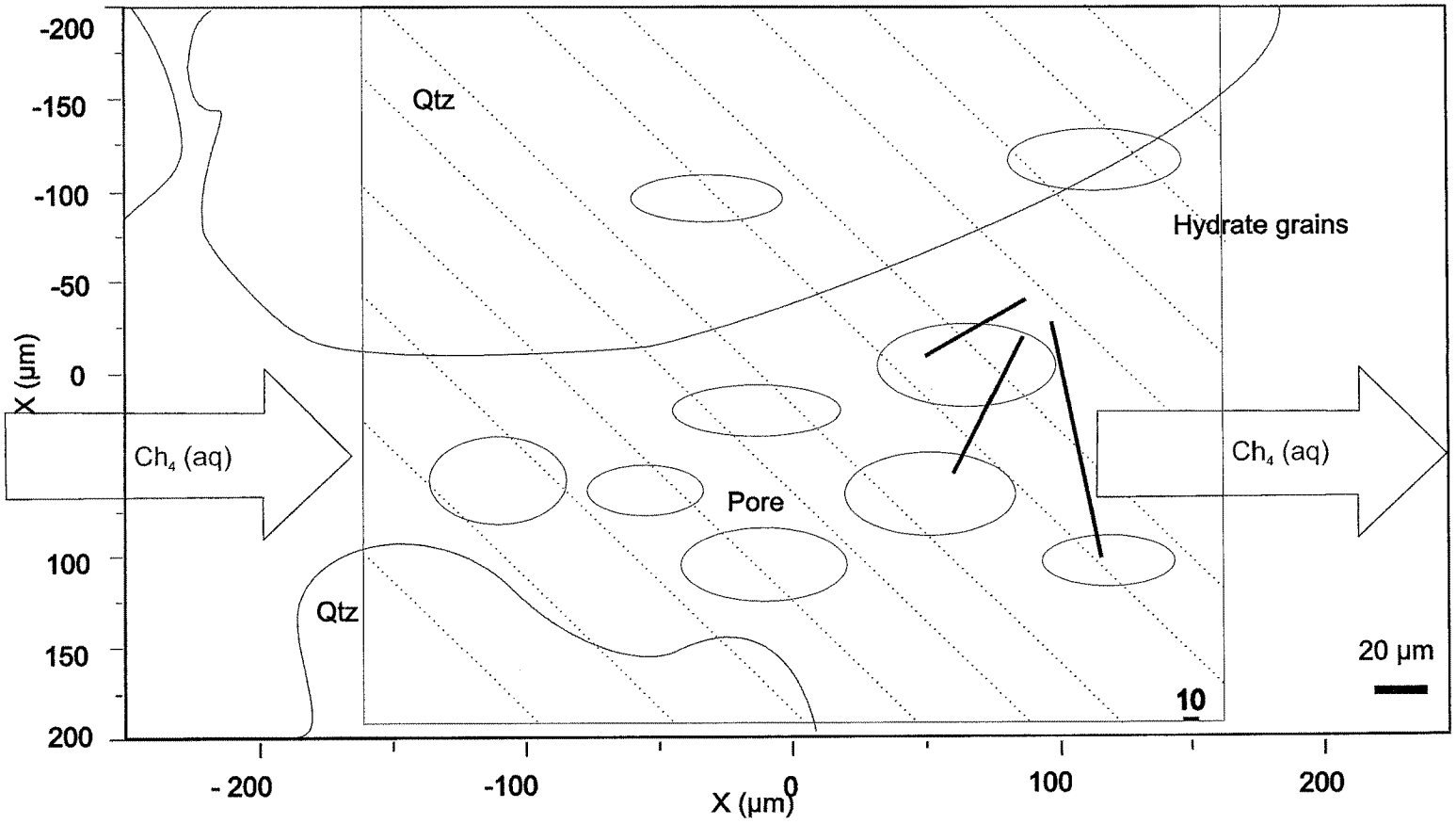
FIG. 4 shows pore filling gas hydrate sediment composites, which exhibit no direct contact between the gas hydrate- and sediment-particles.

When a sediment-wetting fluid phase is used, gas hydrate particles are formed which initially have almost no direct contact or merely force-locked contact with the sediment particles and fill the pore spaces (FIG. 4). Through the formation of these gas hydrate sediment composites, the mechanical and hydraulic properties (e.g., shear strength, permeability) can be influenced slowly and continuously.

In the case of the use of a non-sediment-wetting fluid phase under water-limited conditions, it is possible to form very rapidly massive positive-fit gas hydrate sediment composites which have a high strength and can not be penetrated even at high pressures.

Depending on the application (see also "Application examples"), it may be desired to produce both types of gas hydrate sediment composites.

Figure 5:
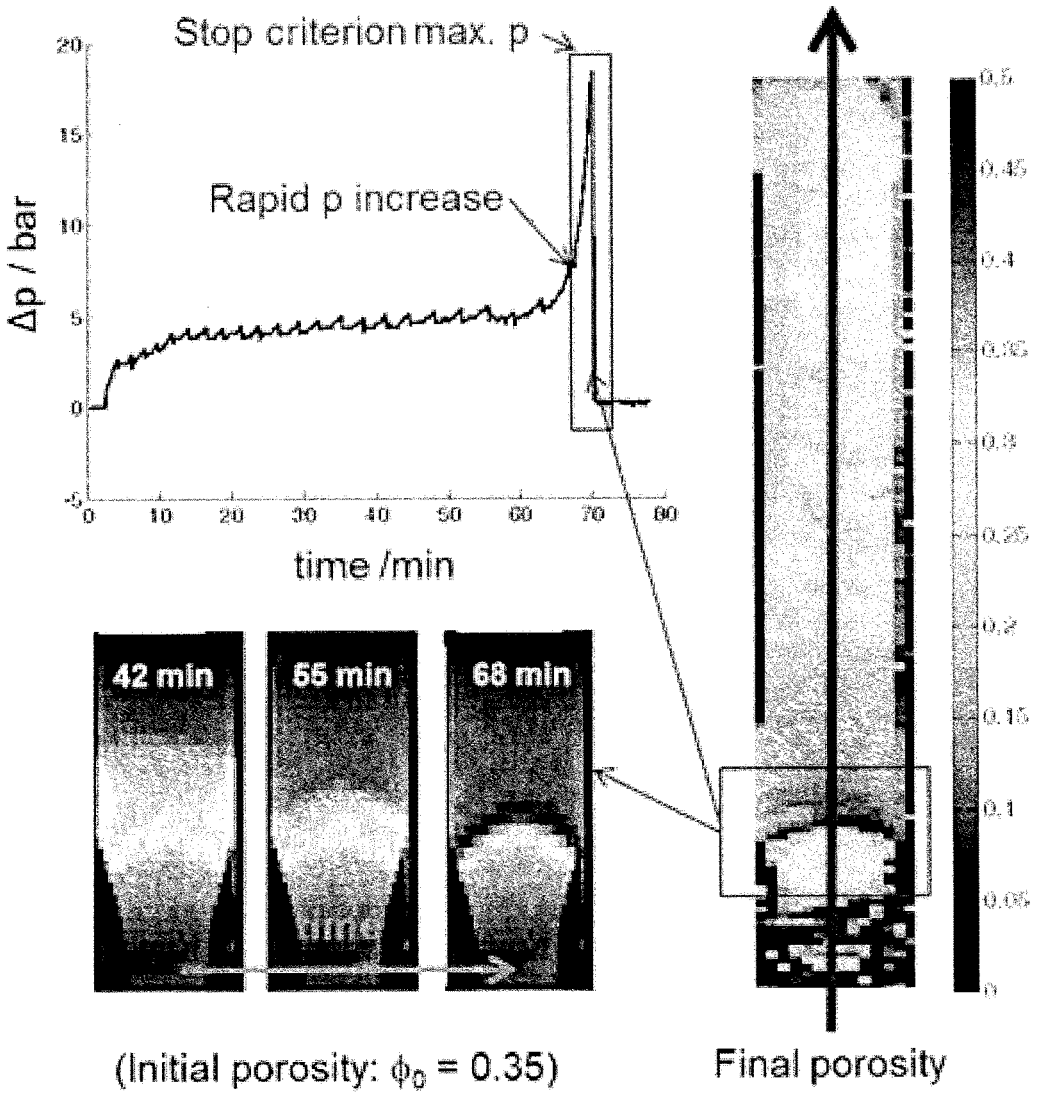
FIG. 5 shows the influence of the gas hydrate sediment composites to the local permeability and that even when using a sediment-wetting fluid phase with discontinuous supply of gas hydrate forming chemicals low permeable gas hydrate sediment composites with high hydraulic resistance are formed.

Even with the use of a sediment-wetting fluid phase, low-permeable gas hydrate sediment composites with high hydraulic resistance can be formed in the case of discontinuous supply of gas-hydrate-forming chemical substances (FIG. 5). By choosing appropriate technical parameters the required composite structures and technical properties can be adjusted continuously.

Furthermore, it is possible to inject firstly a non-sediment-wetting fluid, for example, two-phase $CO_2$-water mixture. In the further course of the injection there can be introduced a transition to a sediment-wetting water-$CO_2$ mixture, that is, a two-phase fluid with a higher proportion of water. In this way, a gas hydrate sediment composite with a relatively high degree of crosslinking is initially formed and the gas space is then filled with gas hydrate.

Surface wetting fluid phases are, under suitable conditions, for example, aqueous solutions with high $CH_4$— or $CO_2$-concentration. Non-surface wetting fluid phases are, under suitable conditions, for example, $CH_4$ gas or liquid $CO_2$. Relevant surfaces are surfaces of sediment particles, gas hydrates and injected technically relevant solids.

The temporal and local availability of water is of great importance for the formation of the defined gas hydrate sediment composites. Water limitation is given when no mobile water is present at the time of the formation of gas hydrate sediment composites or the water present is not a continuous phase. The water present at the respective time under these conditions wets surfaces in the gas hydrate sediment composite, is retained by in pore throats by capillary forces, or is temporarily present as a constituent of the injection fluid as a dispersed, non-continuous phase. Water limitation is also characterized in that, during the formation of the gas hydrate sedimentary composites, the gas hydrate forming gas is present in excess and the maximum amount of gas hydrate which can be formed at the respective point in time is limited by the amount of water. The availability of water is controlled by the injection of a non-sediment-wetting phase and the targeted displacement of existing pore water, or by the defined addition of water as a component of the injection fluid. By injecting a defined surface-wetting or non-surface-wetting fluid or fluid mixture and the regulation of water availability (limited or not limited), in conjunction with knowledge of the chemical and physical properties of the surfaces present at the particular time in the gas hydrate-sediment composite, the location of the gas hydrate formation and the primary type of composite are defined on the grain scale (positive or non-positive connection or no connection between sediment granules and gas hydrates).

A preferentially form-fitting or positive composite on grain scale is in particular established when, under water-limited conditions, gas hydrates are first formed with non-mobile water in pore throats and then intensified with discontinuous water limitation. Non-mobile water is water that is retained in the sediment or in the gas hydrate sediment composite due to surface or capillary forces. A positive-fit composite in the gas hydrate sediment composite can also be present if gas hydrates and sediment particles do not undergo a direct chemical bonding in the sense of a cementation and the common boundary surface is characterized by the presence of a water film on the molecular scale. A preferentially frictional connection (non-positive connection) on a grain scale is particularly given when gas hydrates are first formed in the pore spaces as a disperse phase and with advancing grain growth contact and friction surfaces are formed between gas hydrate and sediment particles.

This knowledge can be implemented to solve various technical problems, these are described in the following (technical application).

Stability of Gas Hydrates

Figure 6:
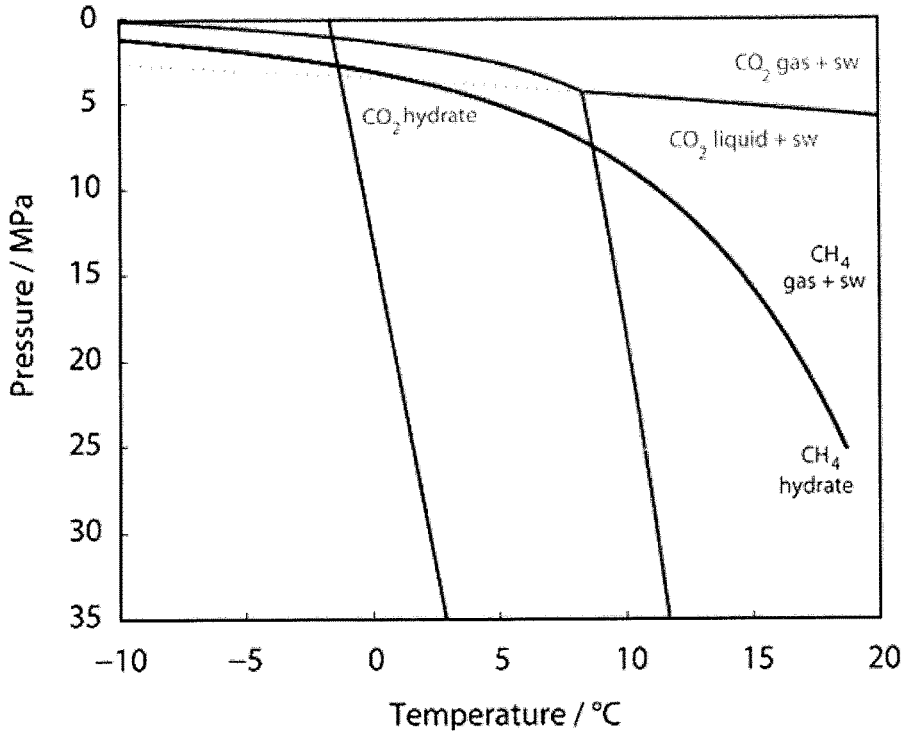
FIG. 6 shows the stability of gas hydrates (in this case $CH_4$ and $CO_2$) as a function of pressure and temperature.

The stability of gas hydrates depends on the pressure and temperature conditions, the nature and concentration of the particular hydrate forming agent and the presence of additional inorganic and/organic chemical compounds. FIG. 6 shows the stability of gas hydrates (in this case $CH_4$ and $CO_2$) as a function of pressure and temperature. These parameters can be influenced in technical processes so that the formation and stability of the gas hydrate can be defined and controlled according to the application-specific requirements. The technical measures proposed according to this invention and further explained below for formation of defined gas hydrate sediment composites from different gas hydrates thus provides an ideal procedure for compaction and consolidation of sediments in the deep sea.

Structures of Gas Hydrate Sediment Composites and their Technically Usable Properties The mechanical and hydraulic properties of gas hydrate sediment composites depend on numerous physicochemical and structural properties, which can be technically affected. The prime factors include pressure and temperature, the composition of the hydrate-forming single-phase or multi-phase fluids, that is, the type and concentration of the hydrate formers (for example $CH_4$, $CO_2$ or $H_2S$), water proportion and inorganic or organic chemical additives. Other influencing factors are also directly accessible process parameters such as injection rates and sequences, dwell times and flow paths.

Depending on these influencing factors, different gas hydrate structures are formed, for example, which can be found primarily in the pore spaces, which coat sediment particles or form massive composites and load-bearing composites with the sediment particles. Gas hydrate sediment composites can have different chemical compositions and form various structures.

The chemical-physical and structural properties of the formed gas hydrate sediment composites, such as the nature of the composite or the degree of crosslinking between gas hydrates and sediment particles, define the altered mechanical and hydraulic properties of the sediment formation. Thus unconsolidated sediments which have a low strength and deform plastically in compression, tension, shear, and rotational loads, are targetedly strengthened in the context of technical applications, so that substantially higher loads, for example, due to shear or rotation, can be tolerated.

The hydrate saturation, i.e., the volume fraction of gas hydrate in the otherwise fluid-filled pore space, and the nature of the bond between sediment particles and hydrate structures, directly determines the mechanical and hydraulic properties of the gas hydrate sediment composite. Gas hydrate sedimentary composites with high gas hydrate saturation effect low permeability and high flow resistance. Own experiments have shown for example that the gas hydrate formation from liquid $CO_2$ and free pore water results in the formation of massive and solid gas hydrate sediment composites, which can not be broken apart even at very high pressure differences (bar>150). This type of gas hydrate sediment composite can be used specifically for the limitation of pore water flows up to the hydraulic separation of highly permeable areas, which can be responsible for high water production and premature failure of gas production from gas hydrate deposits (cf. Application Example 4: Mechanical stabilization and hydraulic conditioning of gas hydrate deposits during production and storage). Together with the hydraulic properties, the mechanical properties, strengths and the elastic-plastic behavior during load and deformation are influenced. This is important because different technical applications require different geomechanical properties of the load bearing sediment. While foundations for technical aggregates and pipelines should preferably react in a limited elastic-plastic manner to dynamic stress changes (cf. Application Example 1: Formation of solid foundations for the placement and operation of technical platforms on the seabed), a very stiff behavior in response to load is necessary in the field of borehole stabilization (see. Application Example 3: Stabilization of bore holes). The reaction at destabilization through to the event of failure can be influenced in this way. Gas hydrate sediment composites with very pronounced elastic-plastic behavior will respond to medium to heavy duty applications with measurable deformation, that can be possibly countered technically. In contrast, very strong and rigid structures are hardly deformed until shortly before failure and very suddenly give way. Even this failure case can be put to good use in various industrial applications, when it comes, for example, to a process sequence to initially targetedly solidify certain sediment areas and minimize the permeability, and subsequently to again open specific areas for targeted and rapid flow-through.

Factors to Control the Formation of Defined Gas Hydrate Sediment Composites (GSC, Gas Hydrate Sediment Composites)

Different technical factors were identified as part of a technology for stabilizing and hydraulic conditioning of marine sediments through the specific formation of gas hydrate sediment-composites, wherein the gas hydrate sediment composites can be formed by gas hydrate formation, or by the conversion of existing gas hydrates.

The technical procedure is characterized in that defined single- or multi-phase fluids are injected under optimized process conditions in the sediment and result in the formation of the required gas hydrate sediment composites. The injected fluids can contain different hydrate-forming components (such as $CO_2$, $CH_4$, $N_2$, $H_2S$, ethane, propane, iso-butane), water, and different chemical or biological additives. The injection of these components need not necessarily take place simultaneously, but can also follow defined injection procedures (e.g., changing, alternating injection of hydrate formers and water) to form gas hydrate sediment composites with special properties. The chemical and biological additives can fulfill very different tasks. These additives may be, among other things, organic or inorganic inhibitors such as polymers, organic acids, alcohols, or salts, which directly affect the stability of gas hydrate sediment composites, their rate of formation or gas hydrate saturation in gas hydrate sediment composites or change the fluid properties. In particular, the influence of microbial activity on gas hydrate formation is used in the scope of the invention. For this purpose, microorganisms, their substrates and other substances may be added to the injected fluid to influence the activity of the microorganisms.

Technical Application

The inventive mechanical stabilization and conditioning of hydraulic marine sediments by the formation of gas hydrate sediment composites is to be applied in different technical scenarios. This application scenarios are:

1.) Formation of solid foundations for the placement and operation of technical platforms on the sea bed, 2.) Deep foundations for anchorages, 3.) Stabilization of boreholes, 4.) Mechanical stabilization and hydraulic conditioning of gas hydrate deposits during their production and storage, 5.) Mechanical stabilization of deep-sea slopes.

The inventive method is particularly characterized in that the chemical compounds used are already present in large quantities in the natural marine system and thus no undue burden is placed on the marine habitat by applying the inventive method, in contrast to methods wherein non-natural foreign bodies or substances are introduced, for example, for the purpose of cementing. The application of the method is carried out using additional technical measures that need to be adapted to the respective application. In this context, the injection flow and expansion of the fluids must be rendered technically possible, and the progress of the formation of the gas hydrate sediment composites controlled. The spreading out of the gas hydrate sediment composites is defined by the installation and operation of injection and suction devices. Especially when using the inventive method for the formation of foundations on the sea floor an impermeable barrier layer will be used for the water column, in order to prevent the premature and uncontrolled dissolution of gas hydrate sediment composites. If necessary, additional electrical or mechanical means are used to control the formation of gas hydrate sediment composites. To illustrate the technical approach some possible application examples are described in the following section.

Application Examples

Figure 7:
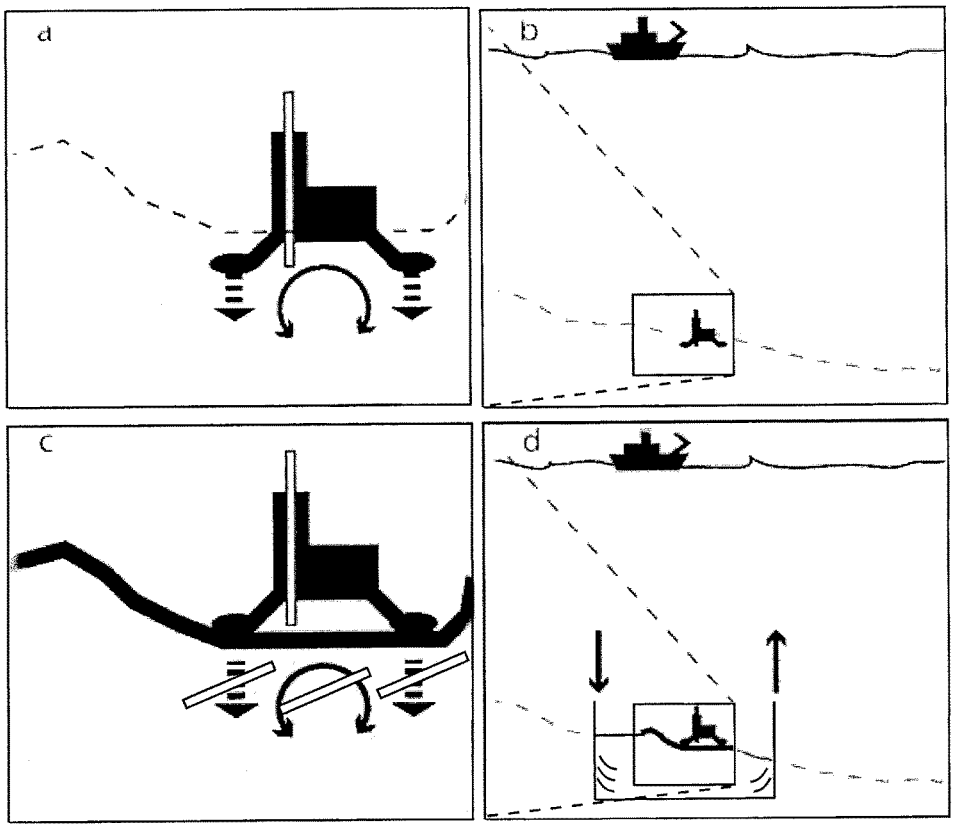
FIG. 7 shows the use of the invention for the formation of solid foundations for the placement and operation of technical platforms to the sea bed.

1.) Formation of Solid Foundations for the Placement and Operation of Technical Platforms on the Sea Floor (FIG. 7)

A pumping station for the distribution of oil should be placed on the seabed and operated continuously over a period of 3 years. The station is located near the continental slope and the sedimentation rate is high. The surface sediment is very loosely layered and ill-defined in its structure and stratification. There are significant concerns from the side of the operators, as to whether conventional foundation techniques such Mudmats or pile foundations, can prevent sinking or tilting of the unit under all load scenarios. To solidify the sediment prior to the installation of the pump unit, injection and suction pipes are installed and the sediment is separated from the water column with an impermeable cover. While a defined negative pressure is generated via the suction lances, the injection lances inject a non sediment-wetting two-phase $CO_2$-water mixture. In the further course of injection, a transition takes place to a sediment-wetting water-$CO_2$ mixture, that is, a two-phase fluid with a higher water content. In this way, a gas hydrate sediment composite is initially formed with a relatively high degree of crosslinking and subsequently the pore space is filled with gas hydrate. Since a small degree of elastic-plastic behavior of the gas hydrate sediment composite is desired due to the vibration-rich operation of the unit, the water injected has been previously loaded with a biodegradable polymer, which initially slows the formation of gas hydrates, so that the injected fluid can spread evenly. The microorganisms present in the sediment degrade the polymer slowly. Once the concentration of the polymer falls below a threshold hydrate formation begins and forms a uniform gas hydrate sediment composite with a medium degree of crosslinking between $CO_2$ hydrate and sediment particles. The strength of the gas hydrate sediment composite facilitates safe placement of the pump unit on the seabed, the thus formed sediment yet also still shows an elastic-plastic behavior, which is advantageous for the vibrating operation of the unit.

Figure 8:
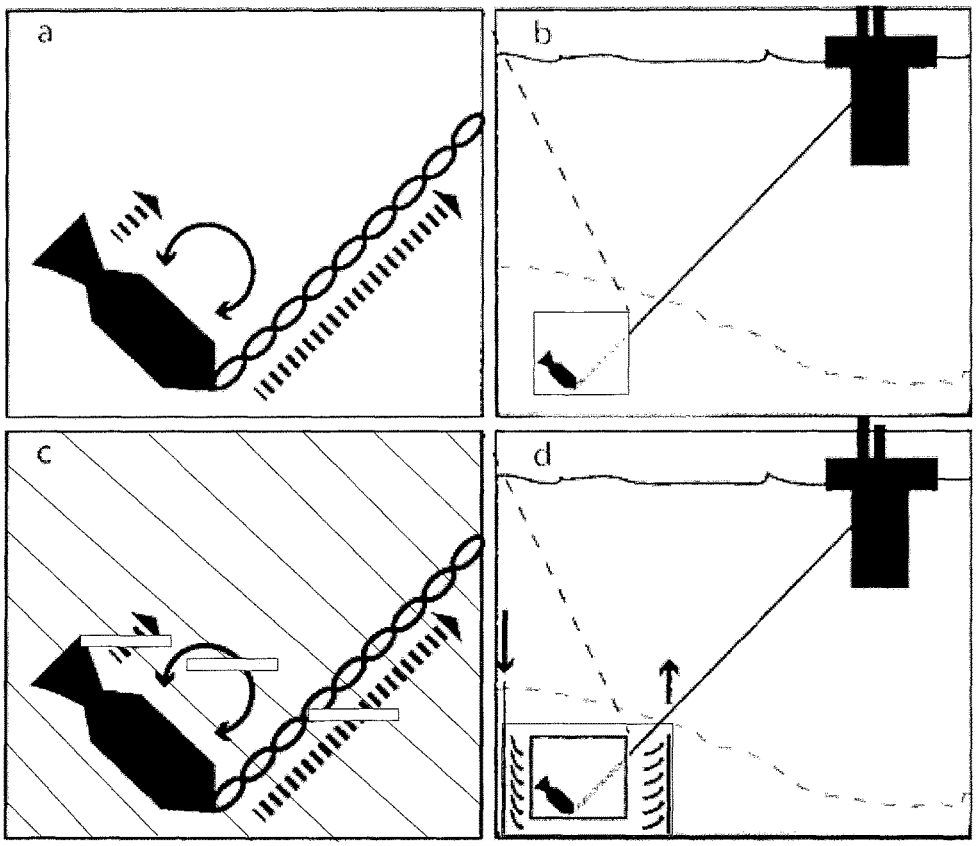
FIG. 8 shows the use of the invention for deep sea foundations for anchorages.

2.) Deep Foundation for Anchorages (FIG. 8)

A production platform is to be built and operated for a period of 20 years. Due to the water depth, a continuous pile foundation is technically very complicated and is excluded for economic considerations. Instead, a conventional anchorage concept is to be utilized in which a plurality of TORPEDO anchors are drawn into the sediment via a tensile load. These anchors are designed to ensure the positioning of the floating production platform via cable connections. However, the existing sediment is unconsolidated and poorly defined. It is feared that the anchors will be drawn from the sediment in extreme weather and wave dynamics exceeding a maximum tensile load. For this reason, after positioning of the anchor, via suction and injection lances, a non sediment-wetting $CH_4$—$CO_2$— mixture is injected alternately with water to adjust an exact water saturation. The water was enriched with a microorganism which uses a short-chain organic acid to form an anti freeze protein, which prevents gas hydrate formation in its vicinity. After consuming the exactly metered substrate, the gas hydrate formation begins and solidifies the sediment. When adjusting the fluid composition and choosing the injection method care is taken that a residual permeability of the sediment is preserved and that the gas hydrates can be replenished around the anchors by subsequent maintenance injections over the very long period of use. Suction and injection lances are therefore made of a highly corrosion resistant material and remain ready for operation at the site.

Figure 9:
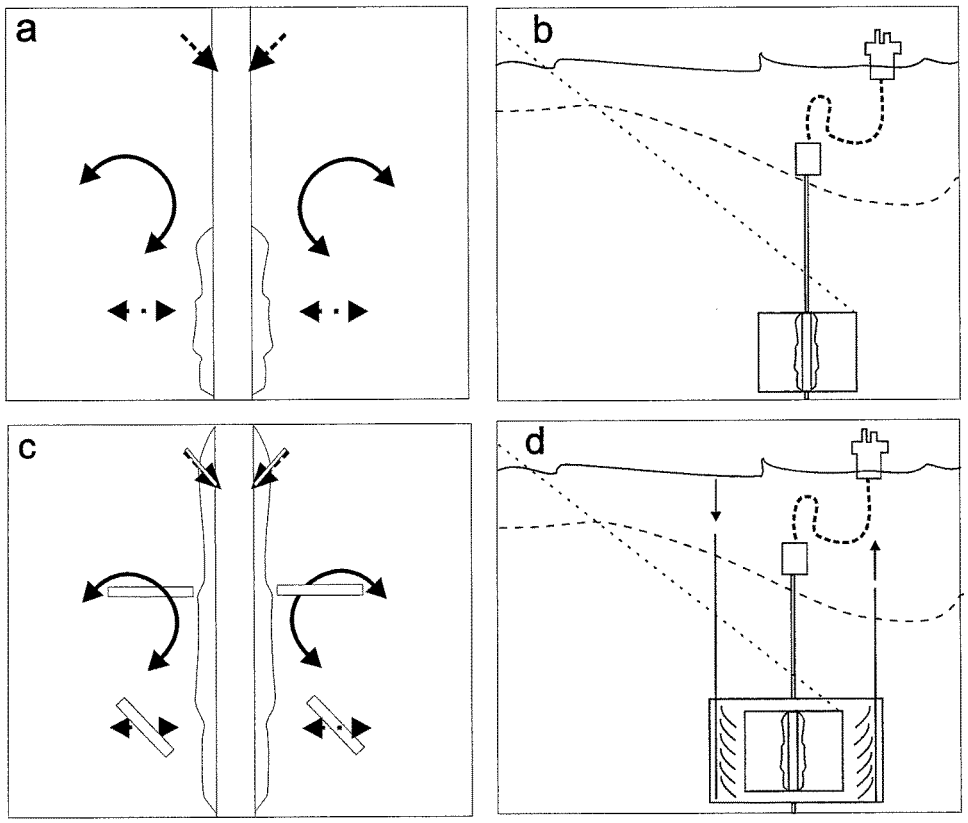
FIG. 9 shows the use of the invention for the stabilization of boreholes.

3.) Stabilization of Bore Holes (FIG. 9)

In the establishment and operation of a bore hole for gas production, major problems are expected from the reservoir engineers, as some heterogeneous gas hydrate layers must be penetrated through at a sediment depth of between 200 and 400 m. In addition, the location is in a very steep section of the continental slope, the sediment is very poorly solidified and some critical voices expected, due to the high organic content, significant gas production rates and changes in pore pressure. Therefore, a decision is made to solidify, prior to the commencement of drilling activity, for an extended range in the appropriate depth, by the formation of a defined gas hydrate sediment composite, and prevent loss of the bore during construction or during operation. The formation of the gas hydrate sediment composite occurs via an array of injection and suction lances. The injection procedure and fluid composition is chosen so that in the central area in the immediate vicinity of the bore solid $CO_2$-hydrates form and strongly and positively cross-link with the sediment. For this purpose initially exclusively and continuously a strongly $CO_2$-enriched aqueous phase (sediment-wetting) was injected. In the further course of the injection, in addition to the $CO_2$-enriched aqueous phase, a finely dispersed pure $CO_2$ phase is injected in order to increase the availability of gas hydrate forming compounds. By this procedure massive gas hydrate sediment composites are formed in the near field of the bore, however, the gas hydrate saturation is kept relatively low in the surrounding area of the bore hole, in order to allow drainage of the fluids with changes in pore pressure. After the formation of gas hydrates, the drilling can be carried out in the solidified sediment without technical problems. Due to the high hydrate saturation the mechanical or thermal destabilization of the bore by the heat input during drilling is prevented, since the sediment extremely cools in this area through the gas hydrate dissociation during the relevant period.

Figure 10:
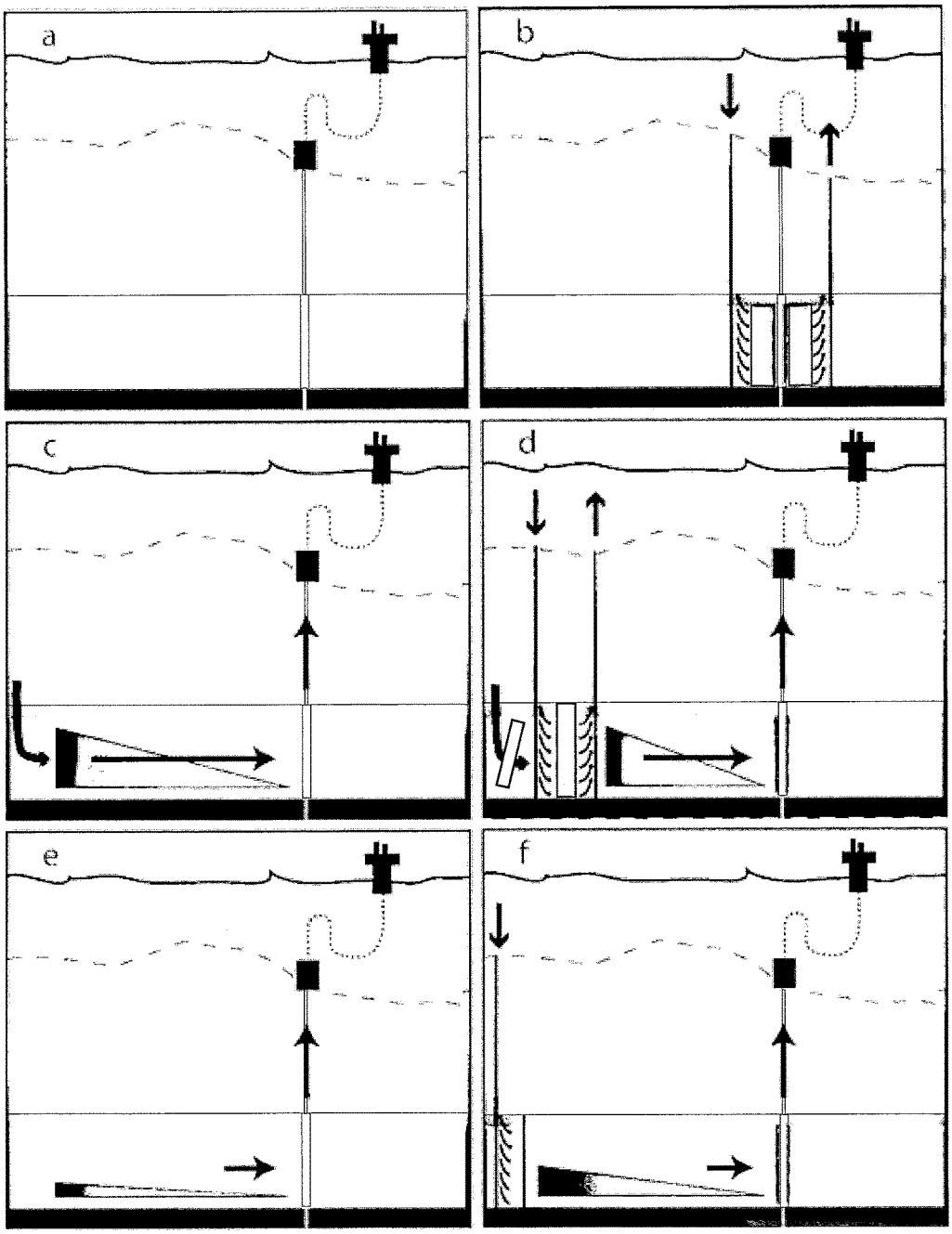
FIG. 10 shows the use of the invention in the production of gas from marine gas hydrate.

4.) Mechanical Stabilization and Hydraulic Conditioning of Gas Hydrate Deposits During Production and Storage (FIG. 10)

In two field tests conducted in the years 2012 and 2013, onshore in Alaska permafrost and offshore in the Nankai trough in Japan, significant technical problems were observed as a result of a destabilization of the sediment and the uncontrolled entry of water into the gas hydrate. The resulting sand and water production has allowed only a short-term gas production over several days. As part of a long-term gas production from marine gas hydrate, primarily by pressure relief, the inventive method can be used in three respects to resolve technical problems.

1.) After setting up the production well, heated supercritical $CO_2$ is first injected alternately with saline water via injection lances that are installed at a short distance from the production well. With this injection procedure very stable gas hydrates are formed slowly and gradually consolidate the area of the well. Due to the increased salt concentration, the maximum rate of hydrate saturation is effectively limited so that a residual permeability of the sediment remains. Upon completion of solidification short horizontal wells are introduced into a lower portion of the reservoir, via which gas production is carried out. The technically produced gas hydrate sediment composites around the production well prevent or minimize sand production, since the vicinity of the borehole can not collapse. Initially, the stabilized, low-permeable area acts like a sand filter. The injection lances remain installed throughout the production period to be able to renewal of the solidification at intervals.

2.) Knowing that the deposit in some areas adjoins highly-permeable sedimentary areas with low hydrate saturation and water threatens to penetrate into the deposit at these sites in the case of the necessary pressure drop for gas production, these areas should be separated using the invention and sealed. For this purpose, once again injection lances are installed and targeted $CO_2$ and alternately water are injected as a sediment-wetting phase. The formation of the gas hydrate sediment composites is kinetically limited by the introduction of a low concentration of gas hydrate inhibitor (e.g., organic polymer), so that the penetration depth of the fluid is sufficiently high. After a short time massive non-permeable gas hydrate sediment composites are formed, which also withstand high loads due to pressure gradients. The gas hydrate barriers are renewed at regular intervals via the remaining injection lances.

3.) After completion of the gas production by depressurization, the pore pressure and the effective pressure in the reservoir is high (i.e., high sediment load with low fluid pressure) and the sediment is over-consolidated. It is foreseeable that with a slow inflow of the surrounding formation water the effective pressure will decrease and a destabilization of the now gas hydrate poor deposit is to be feared. In order to stabilize the deposit for long-term storage, in the final production phase a $CO_2$-water mixture was charged as a sediment-wetting phase through injection lances. The water was previously highly enriched with organic inhibitors that can be biodegraded by microorganisms. The microorganisms reduce the inhibitor concentration to a previously experimentally determined rate such that the onset of gas hydrate formation may be accurately estimated prior to the injection. The injection rate is adjusted by using knowledge of this microbial degradation rate.

Figure 11:
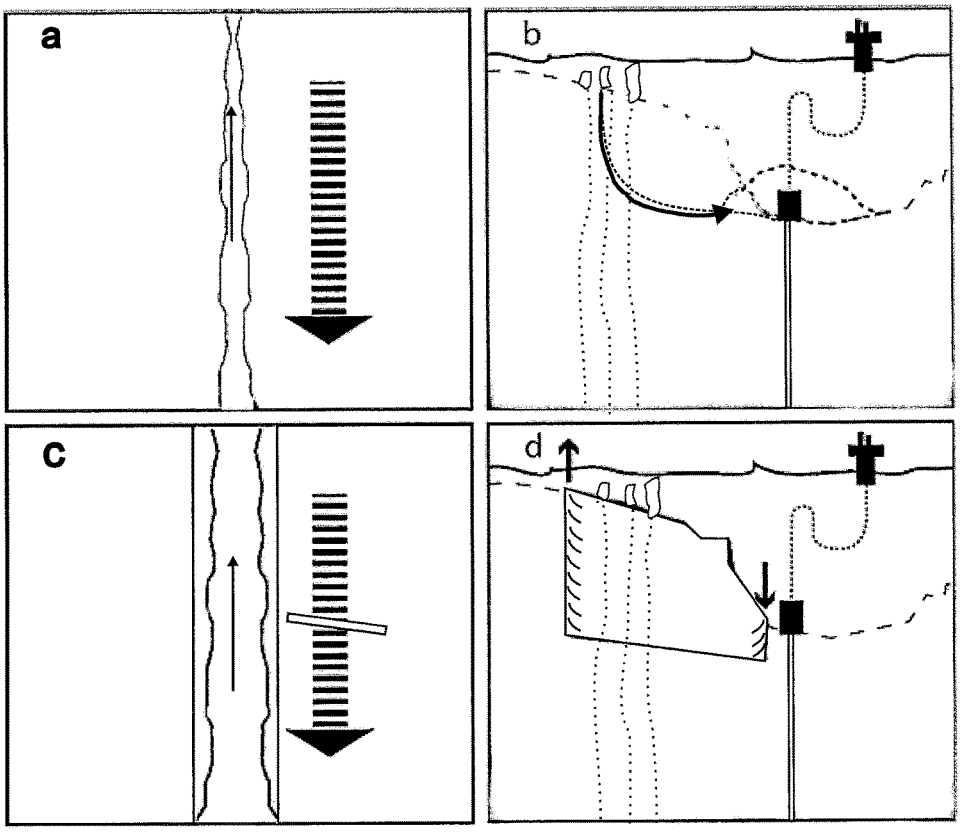
FIG. 11 shows the use of the invention for the mechanical stabilization of deep sea slopes.

5.) Mechanical Stabilization of Deep-Sea Slopes (FIG. 11)

A drilling is carried out in close proximity to a steep slope. It is known that large amounts of gas leak from an incline. Along the unevenly distributed gas leak paths, the sediment is disturbed and mechanically unstable. An uncontrolled landslide is therefore to be expected, as a consequence of which the technical units and the bore hole could be damaged or lost. In order to stabilize the slope, a $CH_4$—$CO_2$-fluid mixture (not sediment-wetting phase) is injected via injection lances and at suction lances a defined negative pressure and a slow flow through the sediment is brought about. In the first step the aim is to achieve an average hydrate saturation in the sediment, wherein the gas outlet paths are not to be sealed. A measurement of the gas composition indicates that the escaping natural gas mainly consists of methane and, in addition, small but significant amounts of higher hydrocarbons are present. This gas mixture in the vicinity of the gas ascent path leads to an increased gas hydrate accumulation starting from the previously technically formed gas hydrate sediment composites and the natural gas ascent paths are additionally stabilized. Finally, the injection is continued with a $CO_2$-rich gas mixture and water, in order to achieve a higher gas hydrate saturation and a better degree of crosslinking in the gas hydrate sediment composite.

The invention claimed is:

1. A method for stabilizing the hydraulic properties of deep sea sediment, marine raw material deposits, and/or deep sea slope, comprising injecting a sediment stabilizing amount of a gas hydrate forming substance into marine or submarine sediments, whereby sediment stabilizing gas hydrate sediment composites are formed.

2. The stabilizing method according to claim 1, wherein in the formation of the gas hydrate sediment composites for static loads and low permeability, the injecting of the gas hydrate forming substances is carried out in a non-surface wetting fluid phase under water-limited conditions.

3. The stabilizing method according to claim 2, wherein the gas hydrate sediment composites are formed rigid, stiff, low-deformable and low-permeability.

4. The stabilizing method according to claim 1, wherein the formation of gas hydrates occurs at fluid-solid and/or fluid-fluid interfaces and/or pore throats.

5. The stabilizing method according to claim 1, wherein the sediment particles are predominantly positively connected.

6. The stabilizing method according to claim 1, wherein for the formation of the gas hydrate sediment composites for dynamic loads and high permeability, the injection of the gas hydrate forming substances occurs in a surface-wetting fluid phase under non-water-limited conditions.

7. The stabilizing method according to claim 6, wherein by injecting the gas hydrate forming substances, deformable, permeable gas hydrate sediment composites are formed.

8. The stabilizing method according to claim 1, wherein the gas hydrates formed by the injection of the gas hydrate forming substances are formed in pore spaces and are not bonded to or are predominantly non-positively connect to the sediment particles.

9. The stabilizing method according to claim 1, wherein before, during or after the formation of the gas hydrate sediment composites a construction of a deep foundation, a deep-sea anchor, a bore hole and/or a closure of a bore hole is carried out.

10. The stabilizing method according to claim 1, wherein with the formation of the gas hydrate sediment composites a filter layer and/or technical barrier is formed.

11. The stabilizing method according to claim 1, wherein before, during or after the formation of the gas hydrate sediment composites natural gas or oil is extracted.

12. The stabilizing method according to claim 1, wherein landslides and sediment movements are prevented by the formation of the gas hydrate sediment composites.

13. The stabilizing method according claim 1, wherein the injection of the gas hydrate forming substances takes place under temporal and/or local availability of water, wherein a water limitation is present if at the time of the formation of gas hydrate sediment composites no mobile water is present or the water that is present is not available as a continuous phase, wherein the water available at any point in time wets surfaces in the gas hydrate sediment composite and is retained in the pore throats by capillary forces or is present as part of the injection fluid temporarily as a dispersed, non-continuous phase.

14. The stabilizing method according to claim 1, wherein the injection of the gas hydrate forming substances takes place under temporal and/or local availability of water, wherein during formation of the gas hydrate sediment composites in water limitation the gas hydrate forming gas is present in excess, and the maximum amount of gas hydrate which can be formed at any time is limited by the amount of water.

15. The stabilizing method according to claim 1, wherein the injection of the gas hydrate forming substances takes place under temporal and/or local availability of water, wherein the availability of water is controlled by the injection of a non-sediment-wetting phase and the targeted displacement of available pore water, or by the addition of defined water as part of the injection fluid.

16. The stabilizing method according to claim 1, wherein the injection of the gas hydrate forming substances occurs by means of a defined surface wetting or surface non-wetting fluid, or fluid mixture, wherein the water availability is controlled and limited or is not limited, is wherein the site of gas hydrate formation and the primary connection type are defined on the grain scale.

17. The stabilizing method according to claim 1, wherein as surface-wetting fluid phases aqueous solutions with high $CH_4$- or —$CO_2$-concentration are used and/or as a non-surface wetting fluid phases $CH_4$ gas or liquid $CO_2$ are used and/or as a relevant surfaces the surfaces of sediment particles, gas hydrates and injected technically relevant solids are used and/or the hydrate forming components $CO_2$, $CH_4$, $N_2$, $H_2S$, ethane, propane, and/or iso-butane are included in the fluid phases.

18. The stabilizing method according to claim 1, wherein the injection of the gas hydrate forming substances comprises alternately injecting hydrate formers and water.

* * * * *